US006338351B1

(12) United States Patent
Schrott

(10) Patent No.: US 6,338,351 B1
(45) Date of Patent: Jan. 15, 2002

(54) METHOD AND METERING DEVICE FOR OPERATING A HOUSEHOLD DISHWASHER

(75) Inventor: Harald Schrott, Lindau (DE)

(73) Assignee: Aweco Appliance Systems GmbH & Co. KG, Neukirch (DE)

( * ) Notice: Subject to any disclaimer, the term of this patent is extended or adjusted under 35 U.S.C. 154(b) by 0 days.

(21) Appl. No.: 09/423,835

(22) PCT Filed: May 16, 1998

(86) PCT No.: PCT/DE98/01371

§ 371 Date: Nov. 16, 1999

§ 102(e) Date: Nov. 16, 1999

(87) PCT Pub. No.: WO98/51205

PCT Pub. Date: Nov. 19, 1998

(30) Foreign Application Priority Data

May 16, 1997 (DE) ..... 197 20 820

(51) Int. Cl.[7] ..... A47L 15/44
(52) U.S. Cl. ..... 134/99.2; 222/652
(58) Field of Search ..... 134/93, 99.2; 68/17 R; 222/652

(56) References Cited

U.S. PATENT DOCUMENTS

| | | | | |
|---|---|---|---|---|
| 2,699,886 A | * | 1/1955 | James, Jr. | 68/17 R X |
| 2,867,224 A | | 1/1959 | Martiniak et al. | |
| 3,013,568 A | | 12/1961 | Getchell et al. | |
| 3,220,607 A | * | 11/1965 | Seal | 134/93 X |

FOREIGN PATENT DOCUMENTS

| | | | |
|---|---|---|---|
| DE | 12 29 030 | 2/1962 | |
| DE | 66 03 555 | 9/1966 | |
| DE | 75 03 703 | 9/1975 | |
| DE | 34 42 194 | 5/1986 | |
| DE | 37 01 404 | 8/1987 | |
| DE | 39 39 402 | 6/1991 | |
| DE | 44 03 191 | 8/1995 | |
| EP | 0 128 073 | * 12/1984 | 68/17 R |
| FR | 2 286 371 | 4/1976 | |

OTHER PUBLICATIONS

International Search Report.
German Search Report.

* cited by examiner

*Primary Examiner*—Philip R. Coe
(74) *Attorney, Agent, or Firm*—Crowell & Moring LLP

(57) ABSTRACT

The invention relates to a method for operating a household dishwasher, said dishwasher being equipped with a program selection device and a combined device for adding a detergent and a clear rinse agent to the washing area. The aim of the invention is to improve the cleaning effect. To this end, the clear rinse agent is added not only once during the last wash cycle, but on several occasions at various times during the wash program. Each of these processes is characterized by an adjustable number of equal quantities or a non-adjustable number of variable quantities of a clear rinse agent. A metering device for carrying out the inventive method comprises a reservoir, a temporary storage unit and a metering chamber. Both the temporary storage unit and the metering chamber can be configured with an adjustable volume.

7 Claims, 1 Drawing Sheet

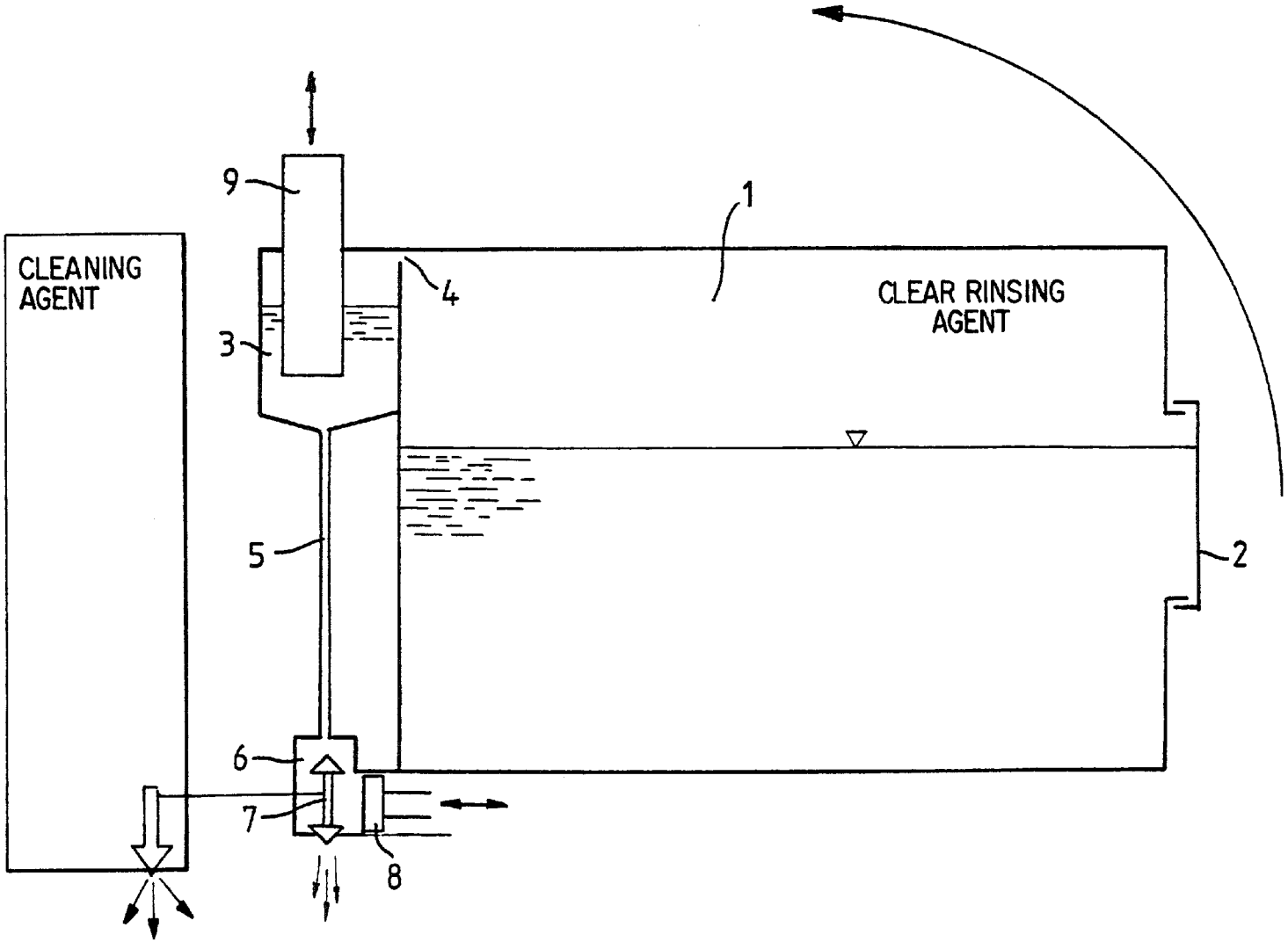
CLEAR RINSING AGENT
CLEANING AGENT
1
2
3
4
5
6
7
8
9

METHOD AND METERING DEVICE FOR OPERATING A HOUSEHOLD DISHWASHER

BACKGROUND AND SUMMARY OF THE INVENTION

The invention relates to a method for operating a household dishwasher and to a metering device which is suitable for carrying out this method.

In household dishwashers, it has been known for many years to add a cleaning agent once during the wash program sequence and to add a clear-rinsing agent at the end of the program sequence in the clear-rinsing section of the program, so that the rinsing water runs off the dishes without leaving drops, so that no spots of limescale remain behind and so that the dishes shine beautifully.

The one-off addition of clear-rinsing agent has led most manufacturers to develop a type of clear rinsing agent metering device which can be described as follows. A small metering chamber, which is also known as the scoop chamber, since it is filled up from a larger reservoir by pivoting the device through 90°, is provided. For this purpose, the metering device is installed in the loading door of the dishwasher, with the result that the metering chamber is filled when the door is opened, i.e. after the program has finished. A valve pin which closes an outlet opening of the metering chamber is lifted at the desired moment by an actuator, e.g. a lifting magnet, so that the entire contents of the metering chamber are able to flow out into the rinsing chamber. In these devices, the volume of the metering chamber, and therefore the amount of agent metered, is determined by means of a displacement member which is allowed to project to a greater or lesser extent into the metering chamber.

German Patent document DE 75 03 703 again proposed a variable metering in which a metering chamber is able to adopt different volumes with the assistance of a displaceable metering piston. In order to rule out the possibility of sealing problems between the metering chamber and the reservoir, in this document a so-called interim store chamber was provided as the outlet chamber into which the metering chamber empties when the-dishwasher door is closed. In this device, the metering chamber can only be filled once, the metered quantity being varied by complex adjustment of the metering piston.

U.S. Pat. No. 2,867,224 describes a metering device which is arranged beneath the base of the rinsing chamber and in which multiple metering of a specific metered quantity is possible with the aid of a pump device using a bimetallic component and a heater device in order to form the bimetallic component.

U.S. Pat. No. 3,013,568 discloses a device in which a metering chamber, dependent on the desired metered quantity, can be filled up a number of times and emptied into the interior of the dishwasher. Owing to the direct contact between the reservoir and the metering chamber, in this device there is the risk of the entire reservoir being emptied into the dishwasher in the event of a leak in the metering valve.

The invention is based on the object of proposing a variable metering device which can be realized with little outlay and, at the same time, avoids the risk of the reservoir being emptied.

Starting from a device of the type mentioned in the introduction, this object is achieved by the fact that an interim chamber is provided, which has a line connection leading to the metering chamber and a refill connection leading to the reservoir, the volume of the interim store being a multiple of the metering-chamber volume.

The interim chamber separates the metering chamber from the reservoir, so that the reservoir is prevented from emptying in the event of a defective metering valve. Large quantities of clear-rinsing agent in a dishwasher have the serious consequence of uncontrolled amounts of foam being formed and emerging from the machine, causing damage. The volume of the interim store only allows a considerably smaller amount of clear-rinsing agent to emerge, so that this risk is avoided.

At the same time, the possibility of multiple filling and emptying of the metering chamber provides the option of an inexpensive yet variable metering device. The efforts to provide a variable metering device are based on the recognition that, in the cleaning or interim rinsing operations, some of the dirt carried in the drops remains attached to the dishes and is thus transferred from one washing liquor to the next. This can be counteracted by adding a small amount of clear-rinsing agent at the end of each of these individual sections of the program which follow one another in the course of the overall program, so that the rinsing liquid and the food residues contained therein drain out better and can thus be pumped away more completely.

The method can be developed in two variants, the practical application being dependent on the control technology used in the dishwasher. On the one hand, it is proposed for the clear-rinsing agent which is introduced within a specific section of the program to be composed of a selectable number of quantities of equal size which are metered in individual, successive metering operations.

A metering chamber whose volume is invariable and whose valve arrangement, when actuated, closes off the inlet opening and opens the outlet opening, is emptied during each metering operation, and thus supplies the same quantity each time. Such a multiple-dose metering device is suitable for modern, electronically controlled dishwashers, in which it is readily possible to fix the number of control pulses as desired in the individual sections of the program and, possibly, to take into account other parameters, such as the type and quantity of load in the dishwasher, the water hardness and the like. Suitable sensors may be provided for the parameters.

In the case of dishwashers with mechanical timers, it is also possible to provide a plurality of successive control pulses within the individual sections of the program. However, it is not possible to vary the number of these control pulses. Therefore, it is proposed for the clear-rinsing agent, which is introduced within a specific section of the program, to be composed of an invariable number of quantities of adjustable sizes, which are metered in individual, successive metering operations. This method variant therefore requires a variable metering chamber.

Advantageously, the interim store is designed as a scoop chamber, which is filled, as is known per se, by pivoting of the metering device, e.g. as a result of the loading door being opened, if the metering device is installed in this door.

Since manufacturing economies require the production of large numbers, the possibility of using a combined metering appliance in a very wide variety of dishwashers is extremely important. As has been mentioned, a simple metering chamber with an invariable volume is sufficient for an electronically controlled dishwasher. In order to be able to use the same metering appliance even for dishwashers with a mechanical timer, it is proposed for the metering chamber to have a variable volume.

Finally, the multiple-application of a metering appliance which has an unchangeable clear-rinsing agent metering chamber can be widened by making the volume of the interim store variable. Such an appliance can be used to add clear-rinsing agent only during the final, so-called clear-rinsing operation, in which case, although the metering takes place in individual quantities, the overall amount is ultimately determined by the volume of the interim store. For example, the timer always emits six control pulses. However, it may be that the interim store, if set accordingly, is empty after the third control pulse, and the metering valve then operates a further three times in the empty state.

The invention is based on the stipulation that a multiple-dose metering device of the type described above is integrated in a combined metering appliance. Combined metering appliances arose in view of the need for economic manufacture and fitting and are contained in virtually all commercially available household (domestic) dishwashers. They comprise a device for introducing a cleaning agent, which is mostly used in powder form, and a device for introducing a liquid clear-rinsing agent into the rinsing chamber; it is already known to actuate both devices by means of the same actuator, in particular by means of a lifting magnet or a bimetallic actuator. The type of electric signal or some other method is used to differentiate whether the cleaning-agent dispenser or the clear-rinsing agent metering device is to be actuated.

The known combined metering appliances are designed in such a way that the cleaning-agent dispenser is actuated first, followed by the clear-rinsing agent metering device. This corresponds to the natural program sequence and represents an important precondition for the conversion, which is proposed by the invention, of the known single-dose metering appliances into multiple-dose metering appliances. Once the cleaning-agent dispenser has been released, there is nothing standing in the way of repeated actuation of the clear-rinsing agent metering device.

BRIEF DESCRIPTION OF THE DRAWING

An exemplary embodiment of the invention which also shows the possible variants is explained below. The single FIGURE represents a diagrammatic sectional drawing through a clear-rinsing agent multiple-dose metering device.

DETAILED DESCRIPTION OF THE DRAWING

An interim store 3, which is designed as a scoop chamber, is mounted on a reservoir 1 which has a filling opening with cover 2. The partition has an opening 4 at the top. Therefore, when the entire device, which is installed in this position in a closed door, is pivoted through 90° to the left when the door is opened, the interim store 3 is filled.

The interim store is connected, via a line 5, to a metering chamber 6, in which a valve lifter 7 moves upward out of its at-rest position illustrated in the event of a control pulse. When it does so, the contents flow out of the metering chamber. Aeration and vent lines which are required are not shown in the drawing, for the sake of simplicity.

In addition, or as an alternative, the volume of the metering chamber 6 may be variable, in that the metering chamber is adjoined by a cylinder in which an actuating piston 8 can move. On the other hand, the volume of the interim store 3 may also be adjustable by means of an immersion member 9 which, depending on the setting, projects to a greater or lesser extent into the interim store.

What is claimed is:

1. Metering device for a household dishwasher, which is equipped with a program-selection device, the metering device comprising:

a combined device for introducing a cleaning agent and a clear-rinsing agent into a rinsing chamber, the combined device for introducing the clear-rinsing agent having a reservoir and a metering chamber, an outlet opening in the metering chamber being provided from the metering device;

an interim store having a line connection leading to the metering chamber and a refill connection leading to the reservoir, the interim store being arranged above the metering chamber when the dishwasher is closed, a valve is arranged to connect or disconnect the line connection extending between the interim store and the metering chamber; and wherein the interim store has a volume which is a multiple of the volume of the metering chamber.

2. Metering device according to claim 1, wherein the interim store is a scoop chamber, which is filled by pivoting the metering device.

3. Metering device according to claim 2, wherein the volume of the metering chamber is variable.

4. Metering device according to claim 2, wherein the volume of the interim store is variable.

5. Metering device according to claim 1, wherein the volume of the metering chamber is variable.

6. Metering device according to claim 5, wherein the volume of the interim store is variable.

7. Metering device according to claim 1, wherein the volume of the interim store is variable.

* * * * *